US006837753B2

(12) United States Patent
Shinozaki et al.

(10) Patent No.: US 6,837,753 B2
(45) Date of Patent: Jan. 4, 2005

(54) SPLIT-TYPE CONNECTOR AND CONNECTOR ASSEMBLY

(75) Inventors: Tetsuya Shinozaki, Yokkaichi (JP); Masashi Saito, Yokkaichi (JP); Keigo Atsumi, Yokkaichi (JP); Masanori Wakui, Toyota (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 10/375,755

(22) Filed: Feb. 26, 2003

(65) Prior Publication Data

US 2003/0162428 A1 Aug. 28, 2003

(30) Foreign Application Priority Data

Feb. 26, 2002 (JP) ..... 2002-049538

(51) Int. Cl.[7] ..... H01R 13/434
(52) U.S. Cl. ..... 439/752; 439/489
(58) Field of Search ..... 439/752, 595, 439/489

(56) References Cited

U.S. PATENT DOCUMENTS

| | | | |
|---|---|---|---|
| 4,875,873 A | 10/1989 | Ishizuka et al. | |
| 5,171,156 A | 12/1992 | Nagasaka et al. | |
| 5,201,665 A | 4/1993 | McCardell et al. | |
| 5,569,040 A | 10/1996 | Sumida | |
| 5,790,373 A | 8/1998 | Kim et al. | |
| 5,924,880 A | 7/1999 | Watanabe et al. | |
| 6,193,532 B1 | 2/2001 | Smithson | |
| 6,293,813 B1 | 9/2001 | Johnston et al. | |
| 6,354,164 B1 | 3/2002 | Megason et al. | |
| 6,471,527 B2 | 10/2002 | Fukamachi et al. | |
| 6,544,053 B2 | 4/2003 | Hah et al. | |
| 6,547,574 B2 | 4/2003 | Sasaki et al. | |
| 6,549,424 B1 | 4/2003 | Beseth et al. | |
| 2001/0046798 A1 | 11/2001 | Noro et al. | |
| 2001/0053621 A1 | 12/2001 | Muramatsu et al. | |
| 2002/0037673 A1 * | 3/2002 | Todo | 439/752 |

FOREIGN PATENT DOCUMENTS

| | | |
|---|---|---|
| JP | 10-106665 | 4/1998 |
| JP | 10-241801 | 9/1998 |

* cited by examiner

*Primary Examiner*—Hien Vu
(74) *Attorney, Agent, or Firm*—Gerald E. Hespos; Anthony J. Casella

(57) ABSTRACT

A split-type connector (10) has a holder (11) and auxiliary connectors (28) that can be mounted in the holder (11). A retainer (34) is mountable in the holder (11) and can be moved from a first position where the auxiliary connectors (28) can be mounted in the holder (11) and a second position where the auxiliary connectors (28) are locked. The retainer (34) has returning slanted surfaces (40) for pushing the retainer (34) from the second position to the first position in the process of mounting auxiliary connectors (28) into the holder (11).

17 Claims, 17 Drawing Sheets

SPLIT-TYPE CONNECTOR AND CONNECTOR ASSEMBLY

BACKGROUND OF THE INVENTION

1. Field of the Invention

The invention relates to a split-type connector and connector assembly.

2. Description of the Related Art

Japanese Unexamined Patent Publication No. 10-241801 discloses a split-type connector assembly for gathering ends of an automotive wiring harness laid along a plurality of independent paths and connecting the gathered ends with a piece of equipment or the like. This connector assembly includes a first connector for gathering the ends of the wiring harness and a second connector provided at a mating side. The first connector has a frame-shaped holder with open front and rear ends and auxiliary connectors are insertable into the holder. The second connector includes a receptacle for accommodating the first connector.

The split-type connector assembly preferably has a retainer to lock the auxiliary connectors in the holder of the first connector and to detect whether the auxiliary connectors are mounted properly in the holder. Japanese Unexamined Patent Publication No. 10-106665 discloses a retainer mechanism for doubly locking terminal fittings inserted into a connector housing and detecting whether the terminal fittings have been inserted to proper positions.

The auxiliary connectors are mounted into the holder with the retainer at a partial locking position. The retainer then is moved to a full locking position to engage and lock the auxiliary connectors. Any auxiliary connector that is mounted incompletely interferes with the retainer and prevents the retainer from being pushed to the full locking position. The retainer projects from the outer surface of the holder when the retainer is at the partial locking position and the projecting portion of the retainer interferes with the opening edge of the receptacle when the first connector is urged into the second connector.

Improperly mounted auxiliary connectors are detected by the interference of the retainer and the receptacle when the first connector is connected with the second connector. Such interference also can detect that the retainer was not pushed from the partial locking position to the full locking position even though all of the auxiliary connectors are mounted properly.

The retainer must be at the partial locking position and retracted from the mounting paths of the auxiliary connectors to mount the auxiliary connectors into the holder. However, the retainer may be pushed erroneously to the full locking position before the auxiliary connectors are mounted, and hence the retainer is in the mounting paths of the auxiliary connectors.

In such a case, the retainer interferes with the auxiliary connectors, and the auxiliary connectors cannot be mounted. This requires the retainer to be pulled to the partial locking position, thereby reducing operational efficiency.

The invention was developed in view of the above problem and an object thereof is to avoid inefficiencies when a retainer is inadvertently moved towards full locking position before auxiliary connectors are mounted.

SUMMARY OF THE INVENTION

The invention relates to a split-type connector with auxiliary connectors fit into a holder. The holder has a retainer that is movable between first and second positions. The retainer in the first position is retracted from mounting paths of the auxiliary connectors into the holder so that the auxiliary connectors can be mounted into the holder. However, the retainer in the second position is at least partly in the mounting paths of the auxiliary connectors in the holder to lock the auxiliary connectors. The retainer has at least one returning slanted surface aligned for urging the retainer to the first position in the process of mounting the auxiliary connectors into the holder if the retainer is at the second position or at an intermediate position between the second and first positions. Thus, the mounting operation of the auxiliary connectors is not hindered.

The retainer preferably has a projecting portion that projects from the holder when the retainer is at the first position. Thus, the projecting portion interferes with an opening edge of a receptacle of a mating connector.

A guiding slanted surface preferably is provided on the portion of the retainer that projects from the holder when the retainer is at the first position. An operator may forget to push the retainer to the second position even though all of the auxiliary connectors are mounted properly. However, the inclination of the guiding slanted surface pushes the retainer to the second position as the holder is fit into the receptacle. Thus overall operational efficiency is improved.

The split-type connector preferably comprises restricting means at the outer surface of the holder and engageable with a mating restricting means of the mating connector to prevent the receptacle from being deformed away from the outer surface of the holder. Most preferably, the restricting means is provided on a side of the holder, where the retainer is to be mounted.

The restricting means ensures that the retainer will not deform the receptacle sufficiently for the holder to fit into the receptacle when the retainer is prevented from moving to the second position. Accordingly, the portion of the retainer that projects from the holder contacts the opening edge of the receptacle and detects that the auxiliary connectors are mounted improperly and that the retainer is left at the first position.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
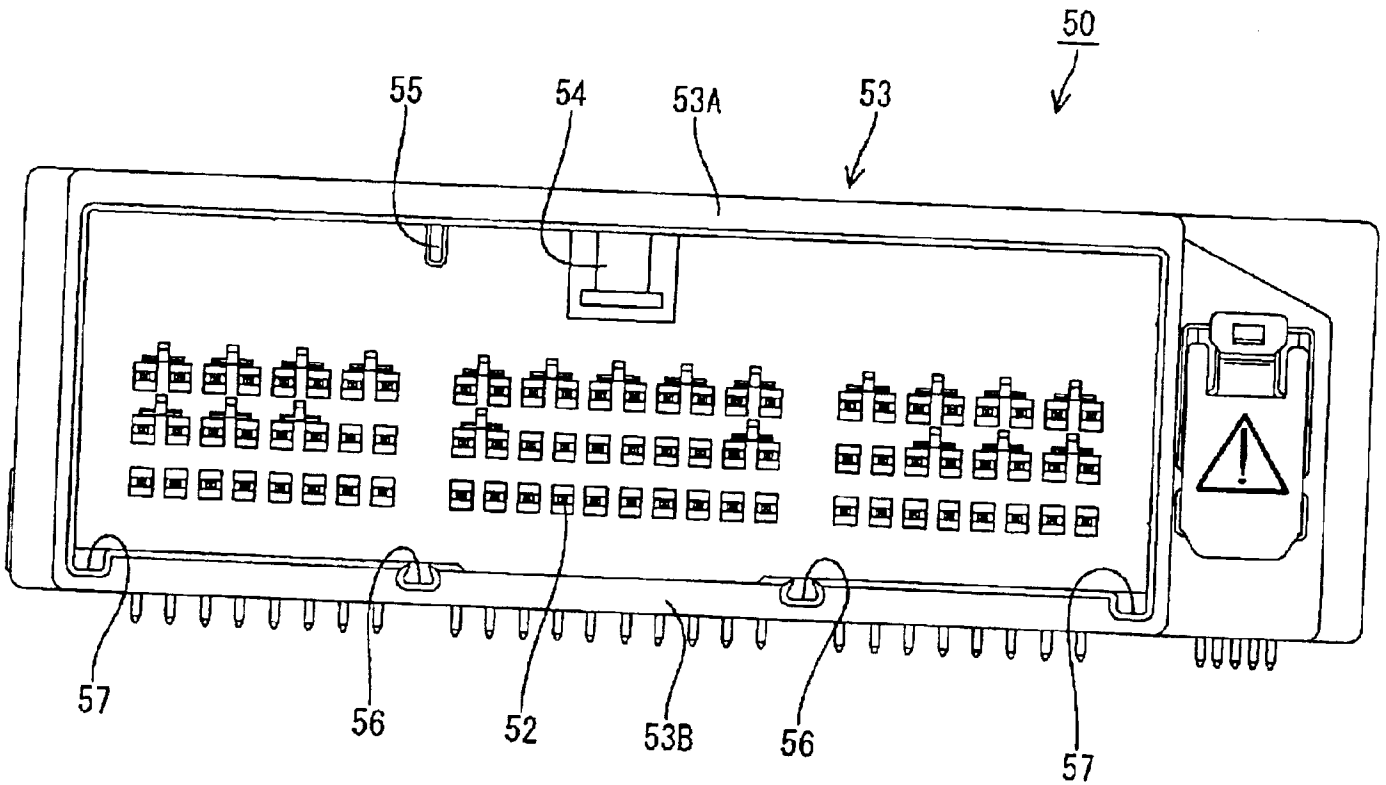
FIG. 1 is a front view of a second connector according to a first embodiment of the invention.
Figure 2:
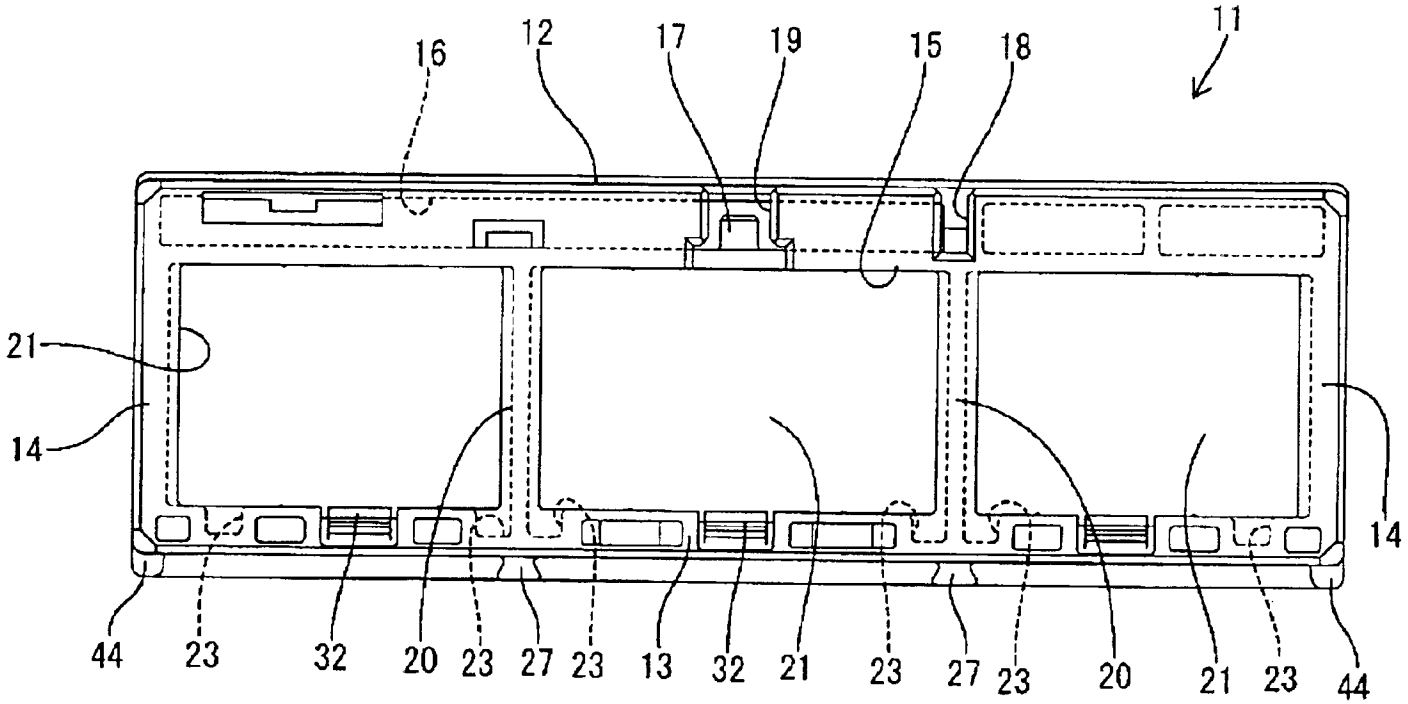
FIG. 2 is a front view of a holder.
Figure 3:
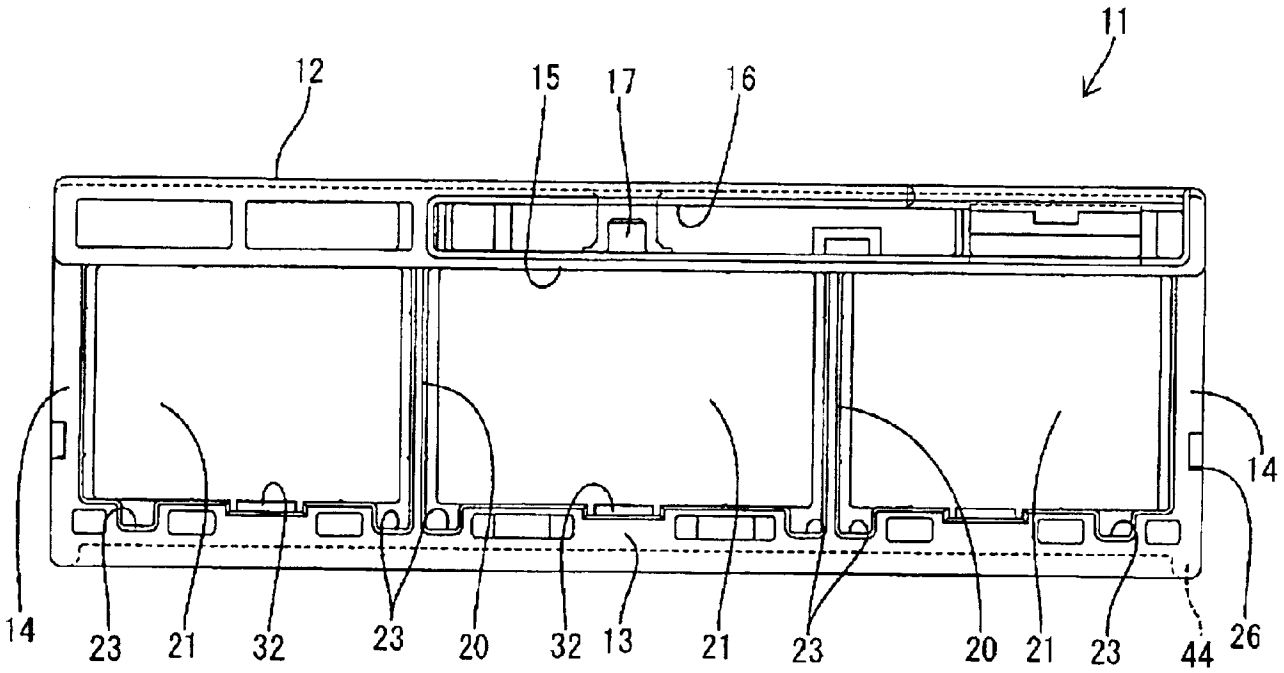
FIG. 3 is a rear view of the holder.
Figure 4:
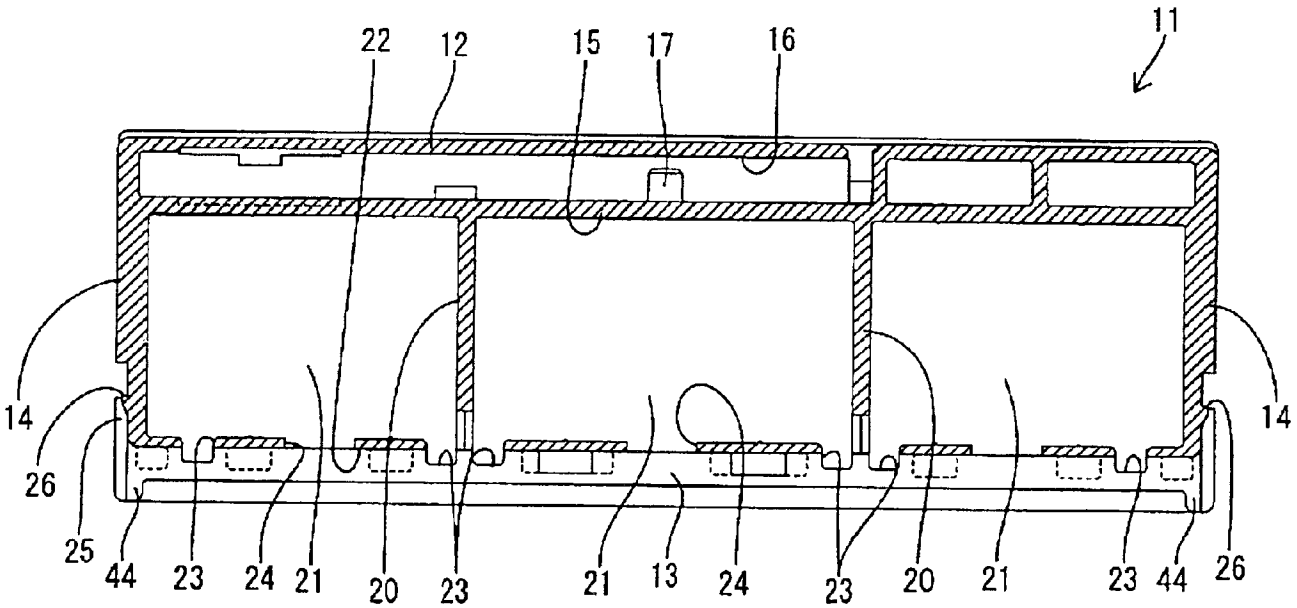
FIG. 4 is a lateral section of the holder.
Figure 5:
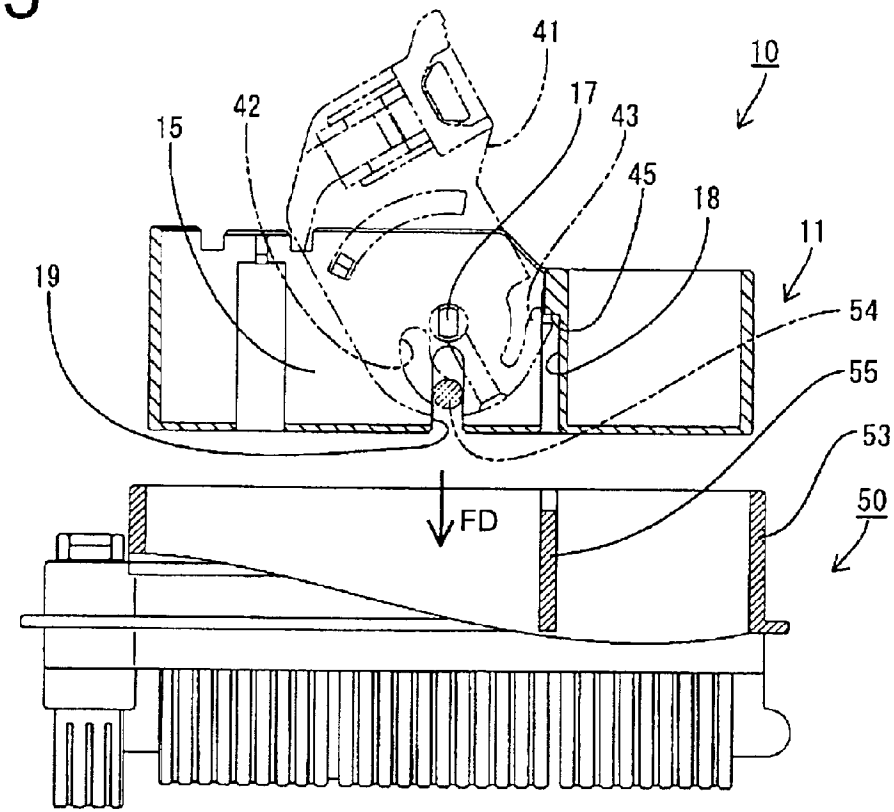
FIG. 5 is a horizontal section showing a state before a first connector and the second connector are connected.
Figure 6:
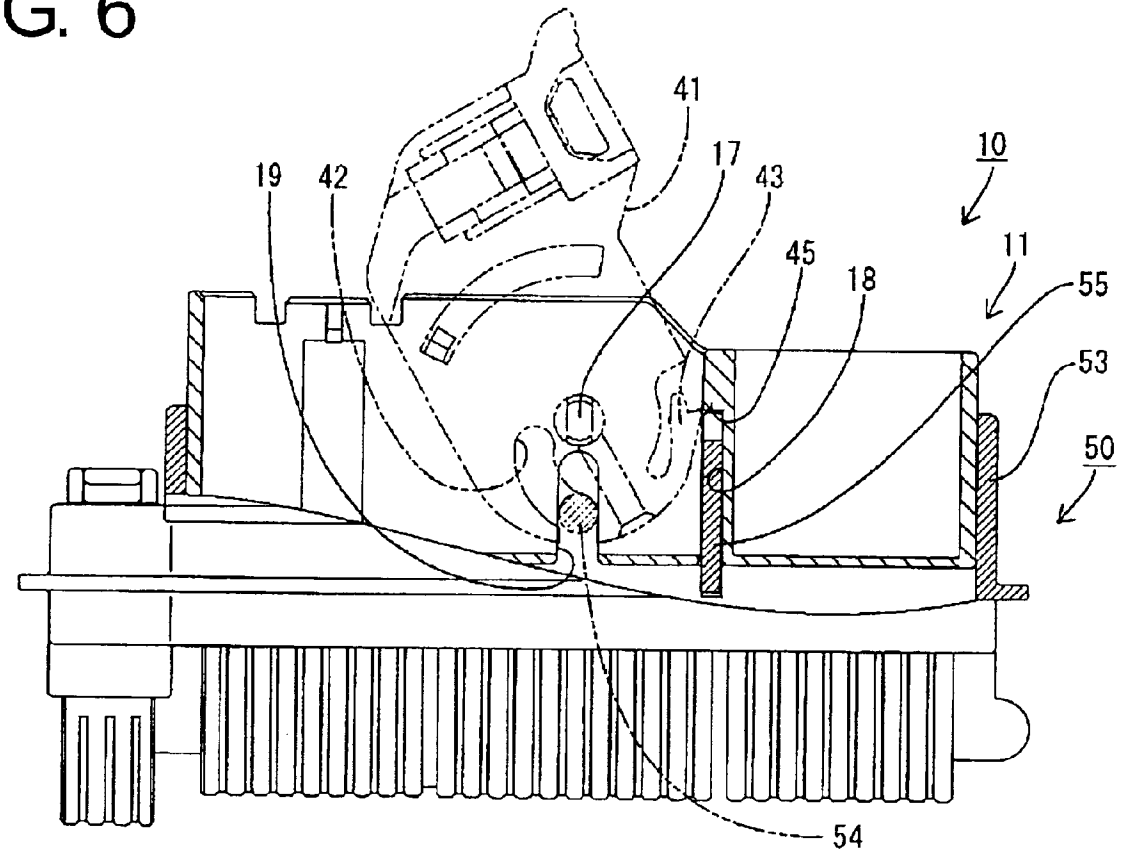
FIG. 6 is a horizontal section showing an intermediate stage of connection of the first and second connectors.
Figure 7:
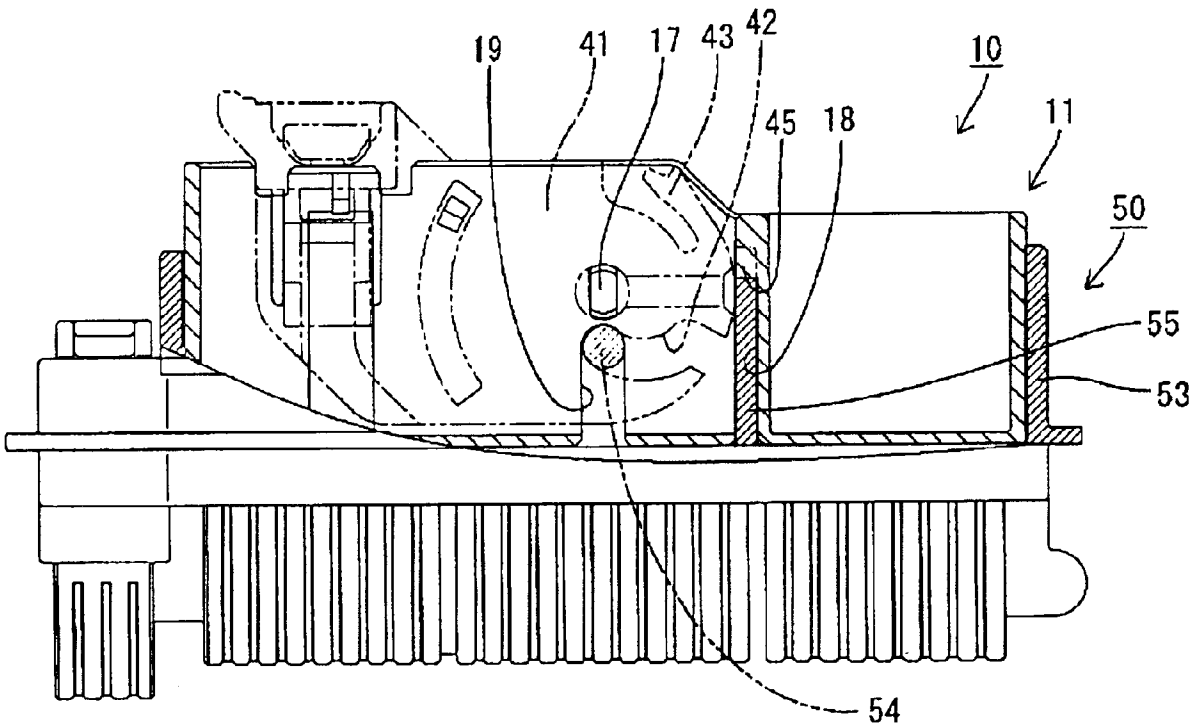
FIG. 7 is a horizontal section showing a state where the first and second connectors are completely connected.
Figure 8:
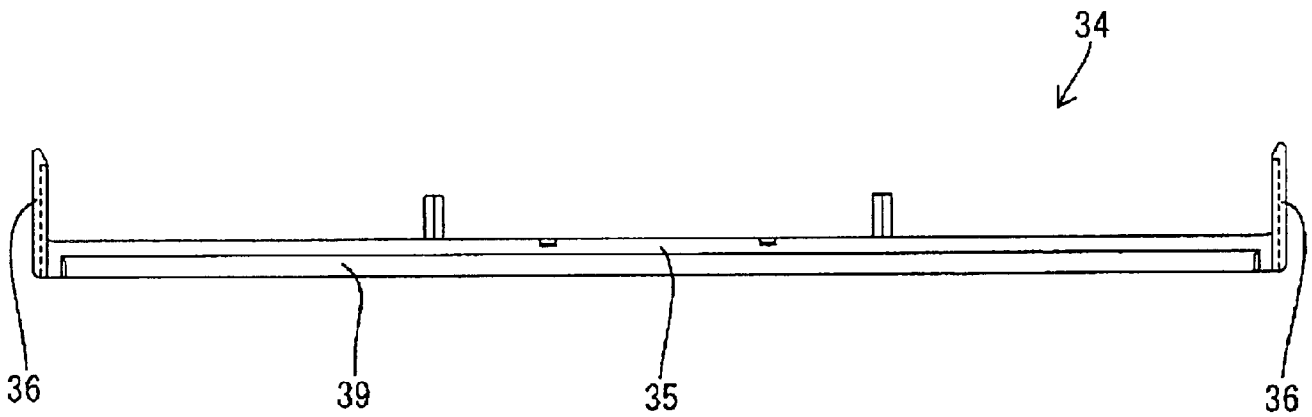
FIG. 8 is a front view of a retainer.
Figure 9:
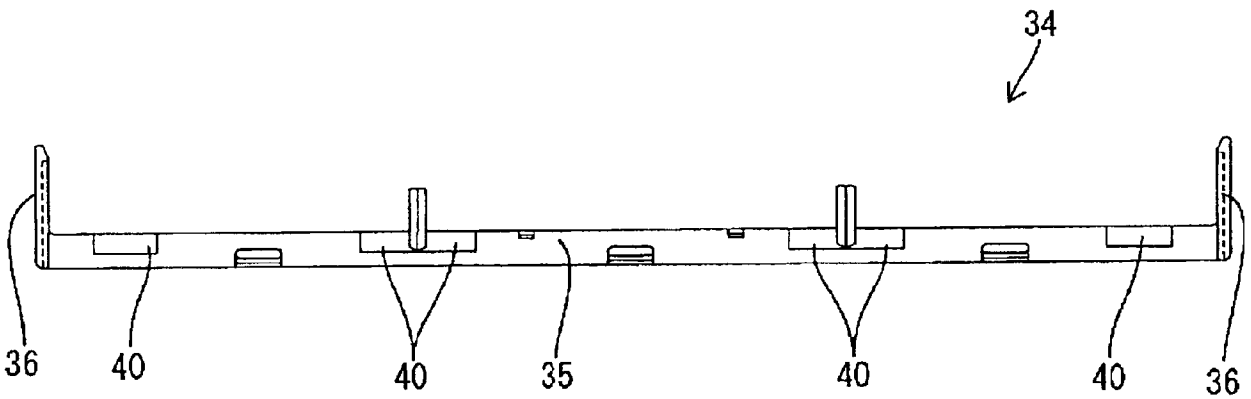
FIG. 9 is a rear view of the retainer.
Figure 10:
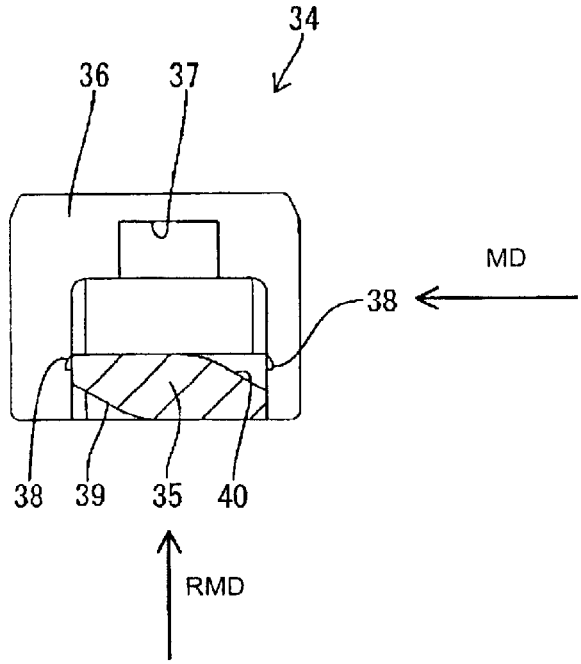
FIG. 10 is an enlarged longitudinal section of the retainer.

A split-type connector assembly according to the invention is illustrated in FIGS. 1 to 17, and includes a split-type first connector 10 and a second connector 50. The first connector 10 has a holder 11 made e.g. of a synthetic resin and defining a wide rectangular frame that is hollow in forward and backward directions. The holder 11 has an upper wall 12, a bottom wall 13 and left and right side walls 14. A ceiling wall 15 extends substantially parallel to the upper wall 12 and is spaced slightly below the ceiling wall 15. Thus, a wide accommodating slit 16 is defined between the upper wall 12 and the ceiling wall 15. A supporting shaft 17 projects upward from the ceiling wall 15 in the accommodating slit 16, and escape grooves 18 and 19 are formed in the upper wall 12. Partition walls 20 extend between the ceiling wall 15 and the bottom wall 13 to define a plurality of transversely arranged mount spaces 21.

A recess 22 extends laterally across the bottom wall 13 of the holder 11 and opens in the left and right side walls 14 of the holder 11. The bottom wall 13 also has detection grooves 23 that open at the rear end surface of the holder 11 and communicate with the recess 22 at the opposite left and right ends of the mount spaces 21.

The bottom wall 13 also is formed with partial locking holes 24 that communicate with the recess 22 and the corresponding mount spaces 21. Escaping portions 25 are formed in the outer surfaces of the left and right side walls 14, and holding projections 26 are formed in the escaping portions 25.

The bottom wall 13 of the holder 11 is formed with left and right trapezoidal ribs 27 that are narrow and long in forward and backward directions. The trapezoidal ribs 27 are at positions substantially corresponding to the partition walls 20 with respect to the transverse direction.

The first connector 10 also includes auxiliary connectors 28. Each auxiliary connector 28 is made e.g. of a synthetic resin and is substantially in the form of a rectangular block. Cavities 29 are formed in the auxiliary connectors 28, and female terminal fittings 30 are inserted into the corresponding cavities 29 from behind. Wires 31 are secured respectively to the female terminal fittings 30 and are drawn out backward through the rear end of each auxiliary connector 28. Each auxiliary connector 28 is mounted from behind into one of the mount spaces 21 of the holder 11 by moving the auxiliary connector 28 along a mounting direction MD. In a mounted state, the front and rear ends of each auxiliary connector 28 are substantially flush with the front and rear ends of the holder 11. The mounted auxiliary connectors 28 are held so as not to come out by resiliently deformable locks 32 provided on the bottom wall 13 of the holder 11.

The bottom surface of each auxiliary connector 28 has a long narrow detection rib 33 that extends substantially parallel to the mounting direction MD of the auxiliary connectors 28 into the holder 11. Each detection rib 33 fits into the corresponding detection groove 23 of the holder 11 as the auxiliary connector 28 is mounted into the mount space 21 of the holder 11. The rear ends of the detection ribs 33 and the front end of the recess 22 are at substantially the same position along the mounting direction MD when the auxiliary connectors 28 reach their proper mount positions.

The first connector 10 further includes a retainer 34 formed e.g. of a synthetic resin. The retainer 34 has a wide narrow main body 35 and left and right locking plates 36 that project up from the left and right ends of the main body 35. The retainer 34 is mounted into the holder 11 in a retainer mounting direction RMD so that the main body 35 engages the recess 22 and the locking plates 36 engage the escaping portions 25. The retainer mount direction RMD of the retainer 34 into the holder 11 is substantially normal to the mounting direction MD of the auxiliary connectors 28 into the holder 11. The bottom surface of the main body 35 is substantially flush with the bottom surface of the holder 11 when the retainer 34 is at a full locking position (see FIGS. 13 and 16). However, the main body 35 projects from the bottom surface of the holder 11 when the retainer 34 is at a partial locking position (see FIGS. 11, 12, 14, 15 and 17).

The main body 35 is retracted from the detection grooves 23 of the holder 11, and hence down from the mounting paths of the auxiliary connectors 28 into the holder 11 when the retainer 34 is at the partial locking position. Thus, the upper surface of the main body 35 is substantially flush with or retracted from the bottom surfaces of the detection grooves 23. Accordingly, the detection rib 33 enters the detection groove 23 as the auxiliary connector 28 is mounted and does not interfere with the main body 35 of the retainer 34. Therefore, the auxiliary connector 28 can be mounted smoothly. Contrary to this, the main body 35 enters the detection grooves 23 and the mounting paths of the auxiliary connectors 28 when the retainer 34 is at the full locking position to engage the detection ribs 33.

The locking plates 36 project substantially along the same direction as the retainer mounting direction RMD of the retainer 34 into the holder 11. Thus, the outer side surfaces of the locking plates 36 are held substantially flush with the outer side surfaces of the holder 11 when the retainer 34 is at any position between the partial locking position and the full locking position.

The locking plates 36 are formed with holding holes 37 (see FIG. 10), that engageable the holding projections 26 of the holder 11 to hold the retainer 34 at the full locking position. The main body 35 is formed with partial locking projections 38 (see FIG. 10) that project forward and backward at substantially the same height as the upper surface of the main body 35. Although not shown, the partial locking projections 38 engage the edges of the partial locking holes 24 of the holder 11 and the upper ends of the locking plates 36 engage the holding projections 26 in the retainer mounting direction RMD so that the retainer 34 is held at the partial locking position in the holder 11.

The main body 35 of the retainer 34 has a guiding slanted surface 39 that extends obliquely from the front surface of the main body 35 to the bottom surface thereof over substantially the entire length of the main body 35. More particularly, the guiding slanted surface 39 is arranged at an angle between 0° and 90° with respect to a fitting direction FD of the first connector 10 into the receptacle 53 of the second connector 50. The guiding slanted surface 39 projects from the bottom surface of the holder 11 when the retainer 34 is at the partial locking position and is engageable with the opening edge 53E of the receptacle 53 of the second connector 50. The main body 35 also has slanted surfaces 40 that extend obliquely from the upper surface of the main body 35 to the rear end surface thereof at positions corresponding to the respective detection grooves 23 of the holder 11. Thus, the returning slanted surfaces 40 are arranged at an angle between 0° and 90° with respect to the mounting direction MD of the auxiliary connectors 28 into the holder 11. The returning slanted surfaces 40 enter the detection grooves 23 and contact the front ends of the detection ribs 33 fit into the detection grooves 23 when the retainer 34 is at the full locking position.

A plate-shaped lever 41 is supported rotatably on the supporting shaft 17 in the accommodating section 16 for rotation between an initial position and a connection completing position. The lever 41 has a cam groove 42 and a resilient locking piece 43 that are in the accommodating slit 16 while the lever 41 is rotated between the initial position and the connection completing position.

The second connector 50 has a housing 51 made e.g. of a synthetic resin and male terminal fittings 52. The housing 51 includes the substantially rectangular receptacle 53 that opens forward toward the first connector 10, and the holder 11 of the first connector 10 is fittable into the receptacle 53. The male terminal fittings 52 project from the back end surface of the receptacle 53. Thus, the male and female terminal fittings 52, 30 are connected when the two connectors 10, 50 are connected properly with each other.

The receptacle 53 has an upper plate 53A and a bottom plate 53B. A cam pin 54 and an unlocking rib 55 project down from the upper plate 53A toward the inner space of the receptacle 53. Left and right dovetail grooves 56 extend forward and backward in the lower plate 53B. The dovetail grooves 56 are dimensioned and disposed to engage the trapezoidal ribs 27 of the holder 11 in the process of fitting the holder 11 of the first connector 10 into the receptacle 53. This engagement of the dovetail grooves 56 and the trapezoidal ribs 57 prevents loose movements at an angle to a direction FD of fitting the holder 11 into the receptacle 53. This connected state is held from the start of engagement of the holder 11 into the receptacle 53 and continues until the two connectors 10, 50 are connected properly. The engagement of the trapezoidal ribs 27 and the dovetail grooves 56 also prevents deformation of the bottom plate 53B of the receptacle 53 away from the bottom wall 13 of the holder 11. As a result, the bottom plate 53B of the receptacle 53 remains substantially parallel with the bottom wall 13 of the holder 11 despite the action of a downward force. Engaging grooves 57 are formed at the left and right ends of the bottom plate 53B of the receptacle 53 and engage guide ribs 44 that project down from the left and right ends of the bottom wall 13 of the holder 11.

Figure 16:
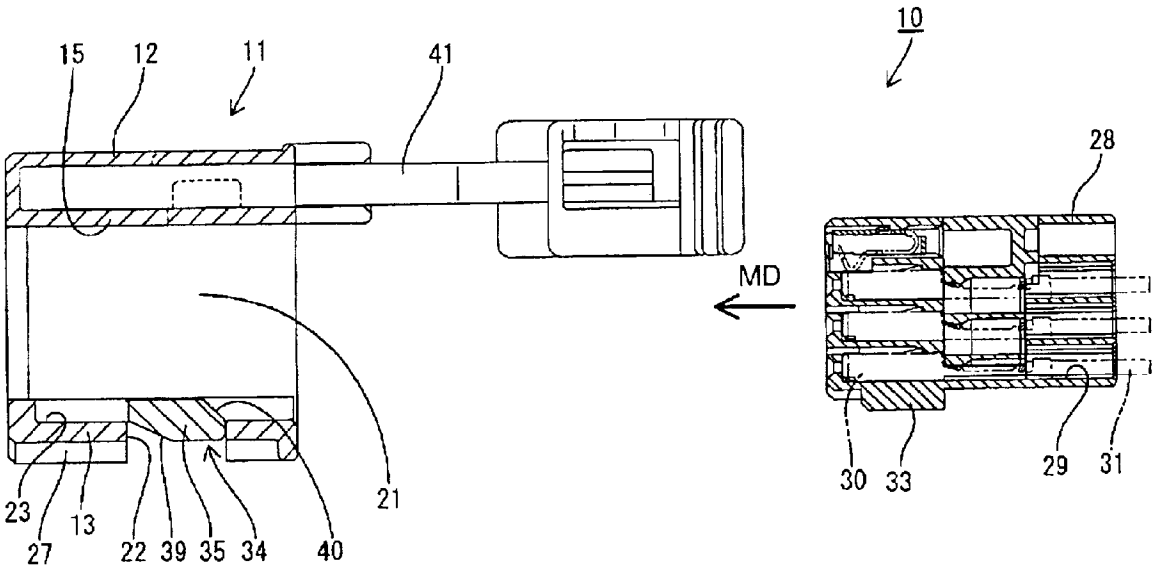
FIG. 16 is a longitudinal section showing the retainer moved to a full locking position before the auxiliary connectors are mounted into the holder.
Figure 17:
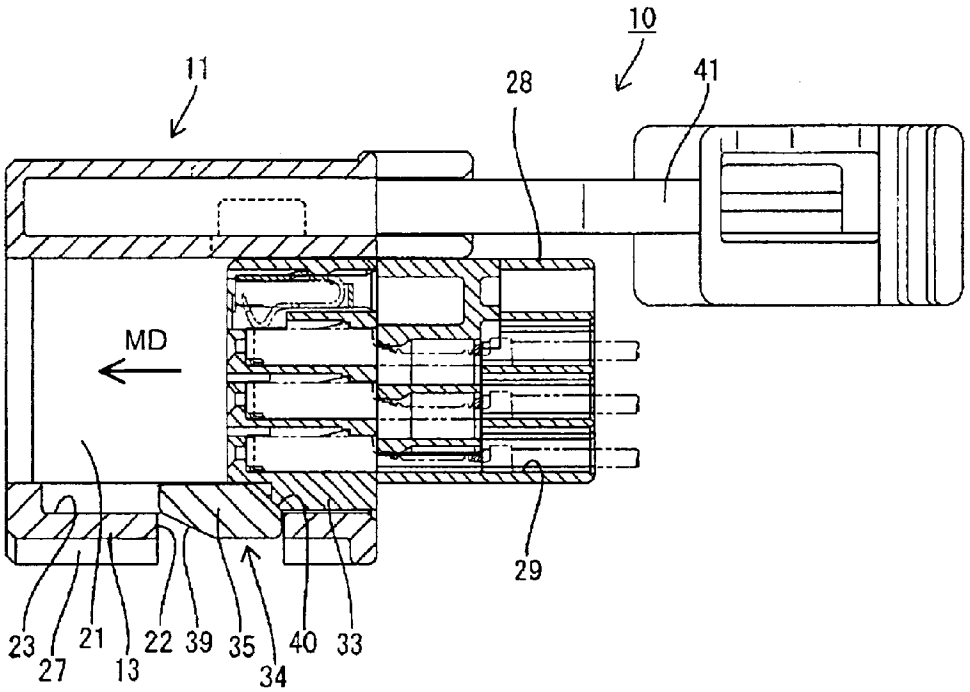
FIG. 17 is a longitudinal section showing a state where the auxiliary connectors are in contact with the retainer at the full locking position in the process of mounting the auxiliary connectors into the holder.

The split-type connector is assembled by first inserting the auxiliary connectors 28 into the mount spaces 21 of the holder 11 in the mounting direction MD, as shown in FIG. 16. At this stage, the retainer 34 is at the partial locking position and the main body 35 is retracted from the detection grooves 23. Thus, the detection ribs 33 of the auxiliary connectors 28 do not interfere with the main body 35 of the retainer 34 as the detection ribs 33 move in the detection grooves 23, and the auxiliary connectors 28 are mounted smoothly.

Figure 11:
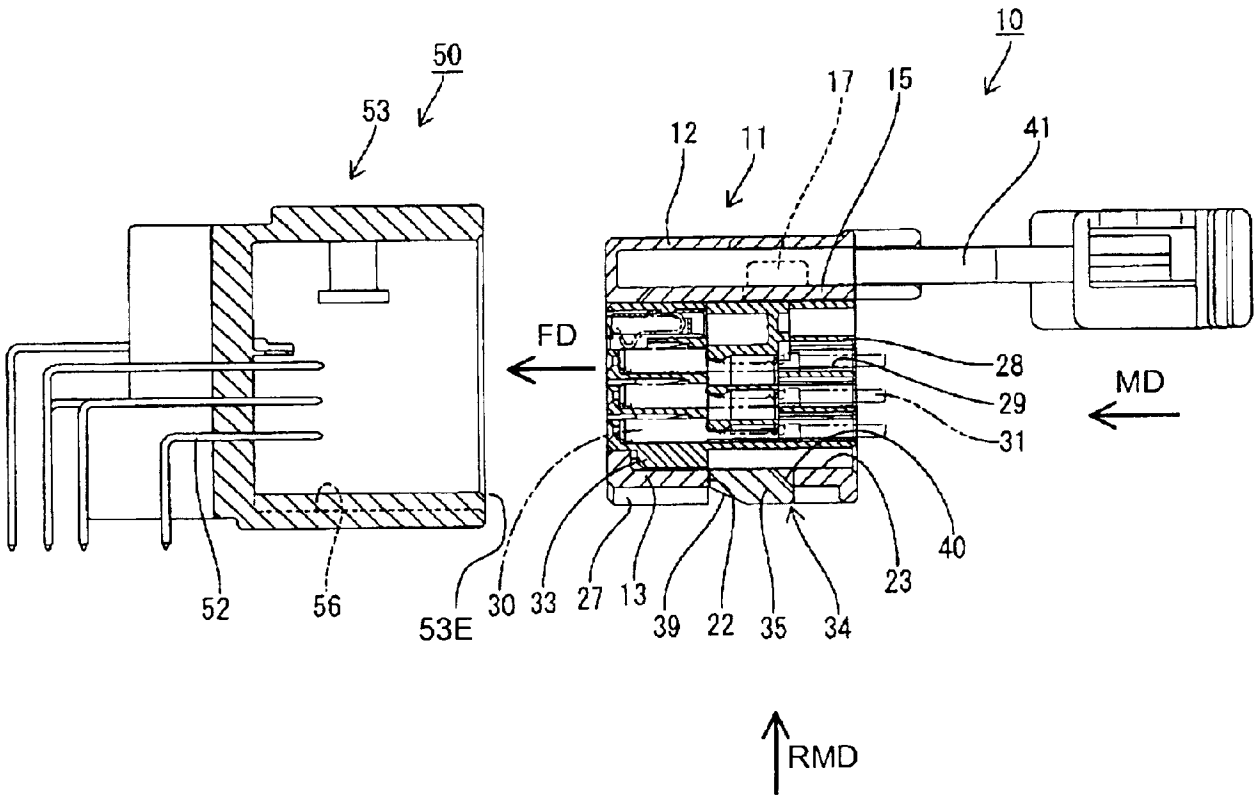
FIG. 11 is a longitudinal section showing a state before the first and second connectors are connected.
Figure 12:
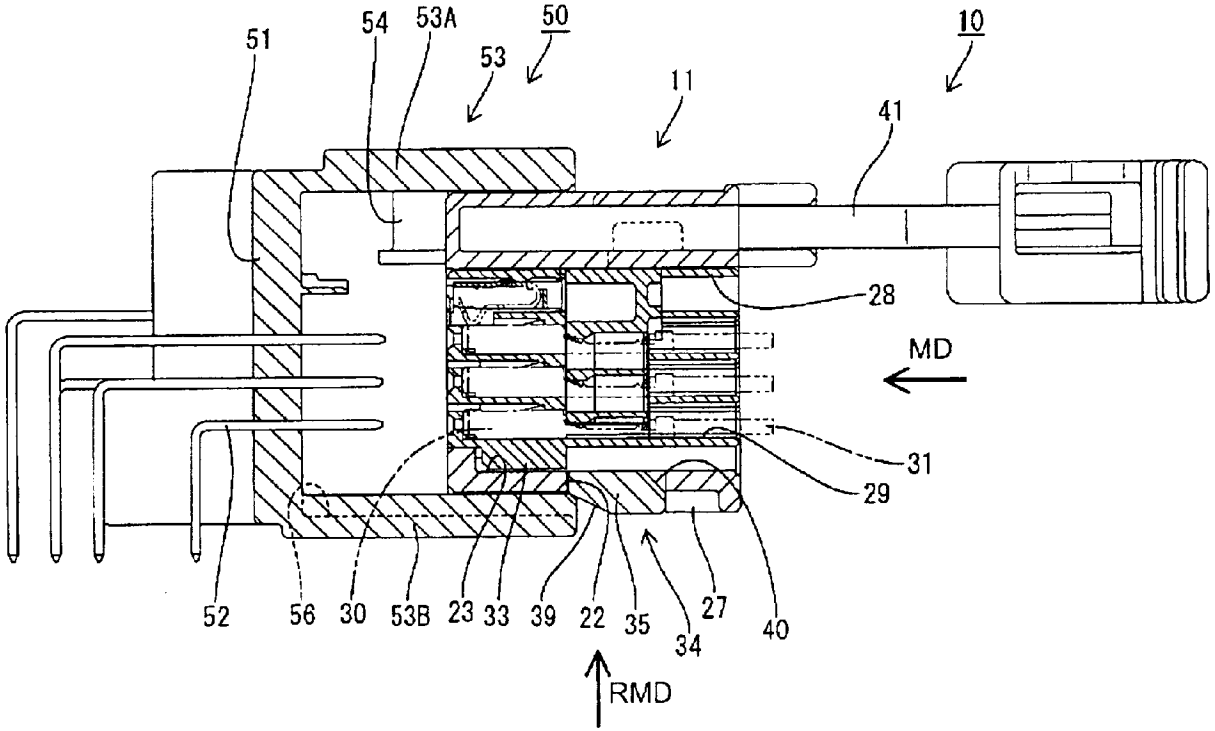
FIG. 12 is a longitudinal section showing a state where the retainer at a partial locking position is in contact with a receptacle in the process of connecting the first and second connectors.
Figure 13:
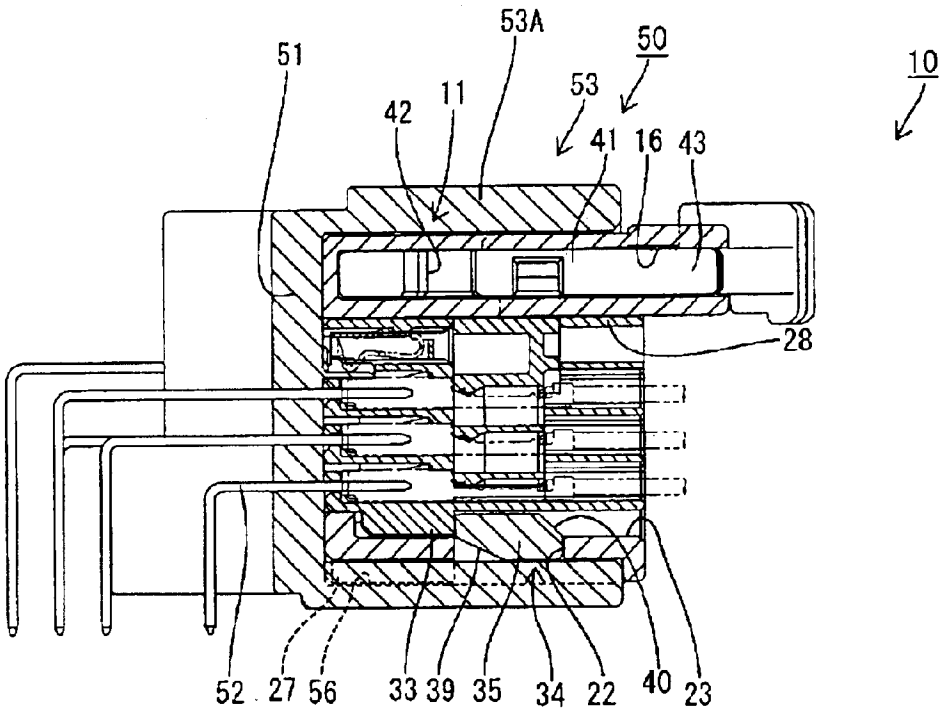
FIG. 13 is a longitudinal section showing a state where the first and second connectors are properly connected.

The detection ribs 33 are located before the main body 35 of the retainer 34, as shown in FIG. 11, when the auxiliary connectors 28 are mounted properly. The retainer 34 then is pushed in the retainer mounting direction RMD from the partial locking position to the full locking position. Thus, the main body 35 enters the detection grooves 23, and the front surface of the main body 35 engages the rear end surfaces of the detection ribs 33 from behind. As a result, the retainer 34 locks the auxiliary connectors 28 (see FIG. 13) to complete the assembly of the first connector 10.

The lever 41 then is set at the initial position (see FIG. 5) so that the entrance of the cam groove 42 faces the escaping groove 19 of the holder 11. In this state, the resilient locking piece 43 of the lever 41 engages the receiving portion 45 of the holder 11 to hold the lever 41 at the initial position. The holder 11 of the first connector 10 is fit lightly into the receptacle 53 of the second connector 50 in this state. Thus, the cam pin 54 enters the cam groove 42 and the unlocking rib 55 deforms the resilient locking piece 43 out of engagement with the receiving portion 45 (see FIG. 6) so that the lever 41 can rotate. Further, the trapezoidal ribs 27 of the holder 11 engage the dovetail grooves 56 of the receptacle 53.

The lever 41 then is rotated so that the engagement of the cam pin 54 and the cam groove 42 pulls the two connectors 10, 50 toward each other. Thus, the holder 11 is fit further into the receptacle 53 with the dovetail grooves 56 and the trapezoidal ribs 27 engaged with each other. The retainer 34 is at the full locking position at this stage, and accordingly the main body 35 of the retainer 34 does not project from the bottom wall 13 of the holder 11. Thus, the two connectors 10, 50 are connected smoothly, and the main body 35 does not interfere with the opening edge 53E of the receptacle 53. The two connectors 10, 50 reach their properly connected state when the lever 41 is rotated to the connection completing position.

The above description applies when both the auxiliary connectors 28 and the retainer 34 are mounted properly. However, the retainer 34 might not be mounted properly even though all of the auxiliary connectors 28 are mounted properly into the holder 11. For example, an operator may inadvertently leave the retainer 34 in the partial locking position or may not push the retainer 34 completely to the full locking position shown in FIG. 11. As a result, the main body 35 of the retainer 34 projects from the bottom surface of the holder 11 and the guiding slanted surface 39 of the retainer 34 projects down from the holder 11 and faces forward. If the holder 11 is urged into the receptacle 53 in this state, the guiding slanted surface 39 of the retainer 34 contacts the opening edge 53E of the bottom plate 53B of the receptacle 53 (see FIG. 12). At this time, the engagement of the dovetail grooves 56 and the trapezoidal ribs 27 prevent the bottom plate 53B of the receptacle 53 from deforming out and away from the bottom surface of the holder 11. Accordingly, the retainer 34 at the partial locking position is pushed up by the inclination of the guiding slanted surface 39 as the holder 11 is mounted, and reaches the full locking position when the opening edge 53E of the receptacle 53 passes the guiding slanted surface 39 (see FIG. 13) to connect the two connectors 10, 50 properly.

Figure 14:
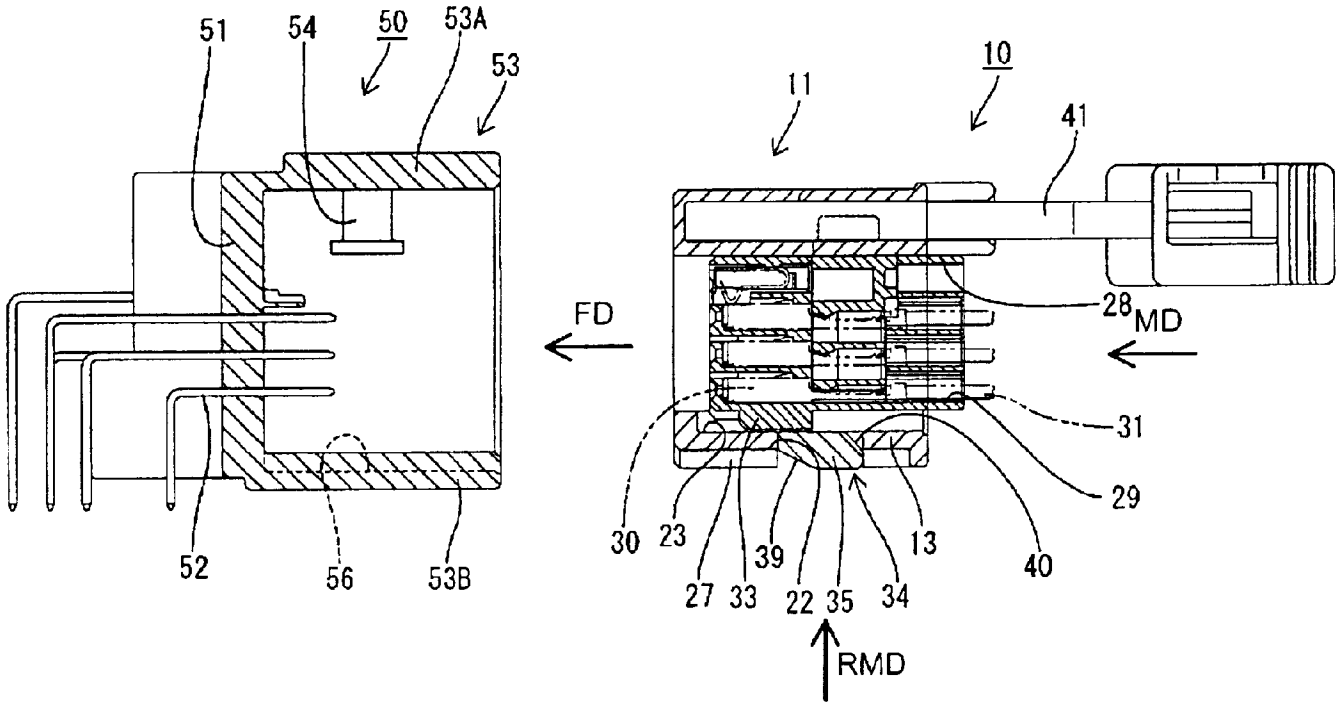
FIG. 14 is a longitudinal section showing auxiliary connectors improperly mounted before the first and second connectors are connected.
Figure 15:
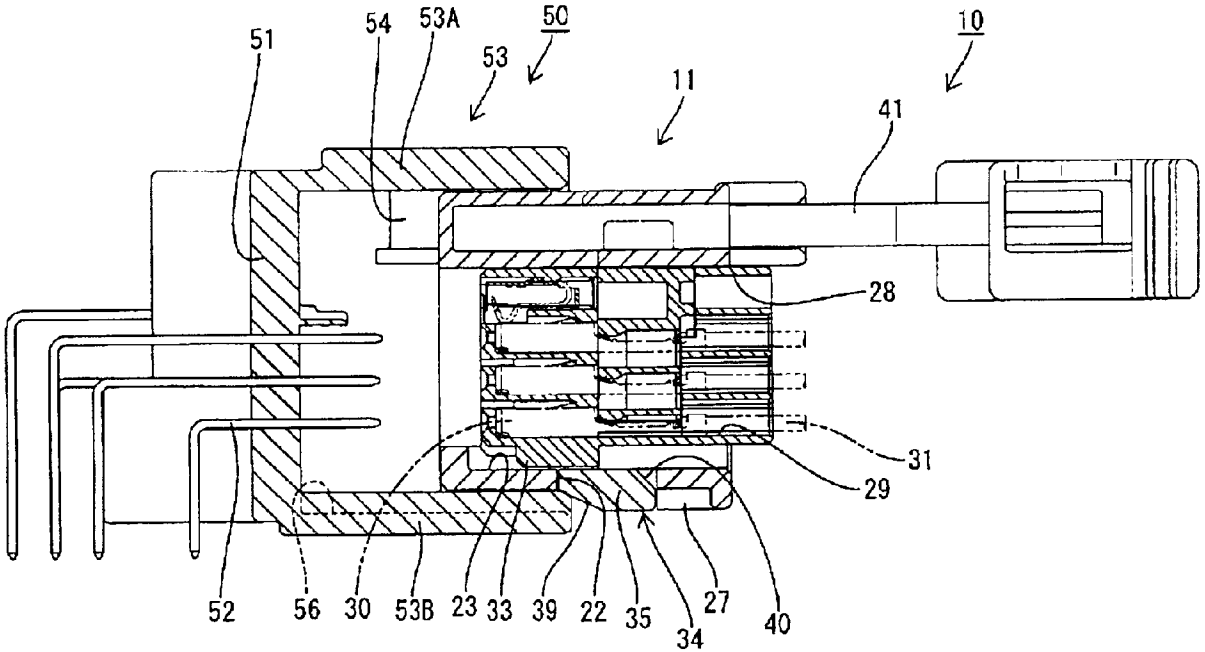
FIG. 15 is a longitudinal section showing a state where an improperly mounted state of the auxiliary connectors is detected in the process of connecting the first and second connectors.

The holder 11 may be urged into the receptacle 53 with the auxiliary connectors 28 improperly mounted in the holder 11, as shown in FIG. 14. In such a case, the retainer 34 cannot be pushed in the retainer mounting direction RMD to the full locking position because the detection ribs 33 of the auxiliary connectors 28 face the upper surface of the main body 35 of the retainer 34. Thus, the main body 35 of the retainer 34 projects from the bottom surface of the holder 11 and the guiding slanted surface 39 faces forward. Accordingly, the guiding slanted surface 39 abuts the opening edge 53E of the bottom plate 53B of the receptacle 53 in the process of fitting the holder 11 into the receptacle 53 as shown in FIG. 15. However, the retainer 34 cannot be moved to the full locking position, as described above, and the holder 11 cannot be fit into the receptacle 53 any further. Further, the engagement of the dovetail grooves 56 and the trapezoidal ribs 27 prevents the bottom plate 53B of the receptacle 53 from deforming down and away from the bottom surface of the holder 11. Thus, the connection of the two connectors 10, 50 is hindered at by the interference of the opening edge 53E of the receptacle 53 and the guiding slanted surface 39, and the improperly mounted auxiliary connector 28 can be detected by this hindrance to the connecting operation.

The retainer 34 may be moved in the retainer mounting direction RMD to the full locking position even though the retainer 34 must be at the partial locking position before the auxiliary connectors 28 are mounted into the holder 11 (see FIG. 16). In such a case, the main body 35 of the retainer 34 is in the detection grooves 23 that are parts of the mounting paths of the auxiliary connectors 28 into the holder 11. Thus, the main body 35 interferes with the detection ribs 33 in the detection grooves 23 as the auxiliary connectors 28 are mounted. However, the main body 35 is formed with returning slanted surfaces 40 that extend from the upper surface of the main body 35 to the rear end surface thereof and substantially corresponding to the respective detection grooves 23. Thus, the detection ribs 33 in the detection grooves 23 contact the returning slanted surfaces 40. As a result, the retainer 34 is pushed opposite the retainer mounting direction RMD from the full locking position back toward the partial locking position by the inclination of the returning slanted surfaces 40 as the auxiliary connectors 28 are mounted further. Therefore, even if the retainer 34 inadvertently is at the full locking position, it does not hinder the mounting of the auxiliary connectors 28.

As described above, the retainer could mistakenly be mounted in the full locking position before the auxiliary connectors 28 are mounted. In this situation, the returning slanted surfaces 40 of the retainer 34 push the retainer 34 from the full locking position to the partial locking position in the process of mounting the auxiliary connectors 28 into the holder 11. Thus, the retainer 34 is pushed out of the mounting paths of the auxiliary connectors 28 and out of the detection grooves 23 by the returning slanted surfaces 40 and is brought to the partial locking position. This avoids a hindrance to the mounting of the auxiliary connectors 28.

The dovetail grooves 56 and trapezoidal ribs 27 prevent the bottom plate 53B of the receptacle 53 from deforming away from the bottom surface of the holder 11. This prevents the retainer 34 from deforming the receptacle 53 sufficiently for the holder 11 to be fit into the receptacle 53 while the retainer 34 is prevented from moving from to the full locking position. Accordingly, the portion of the retainer 34 that projects from the holder 11 contacts the opening edge 53E of the receptacle 53 and detects that the retainer 34 is in the partial locking position and that the auxiliary connectors 28 are mounted improperly.

The means for preventing the deformation of the receptacle 53 is formed simply by the trapezoidal dovetail grooves 56 and the trapezoidal ribs 27. Thus, the shapes of the receptacle 53 and the holder 11 are simple.

Connection could be attempted while the auxiliary connectors 28 are mounted properly, but while the retainer 34 is left at the partial locking position. In this situation, the inclination of the guiding slanted surface 39 causes the receptacle 53 to push the retainer 34 to the full locking position as the holder 11 Further, since the means for preventing the deformation of the receptacle 53 is fit into the receptacle 53. The engagement of the dovetail groove 56 and the trapezoidal ribs 27 prevents the receptacle 53 from moving away from the holder 11. Thus, the retainer 34 can be pushed securely to the full locking position.

Interference with the improperly mounted auxiliary connector 28 could hinder the retainer 34 from being pushed to the full locking position. However, the leading edge of the bottom plate 53B of the receptacle 53 and the projecting main body 35 of the retainer 34 contact each other via the guiding slanted surface 39. Additionally, the dovetail grooves 56 engage the trapezoidal ribs 27 to prevent the bottom plate 53B of the receptacle 53 from moving away from the outer surface of the holder 11. Thus, the main body 35 of the retainer 34 interferes with the bottom plate 53B of the receptacle 53 without forcibly entering the receptacle 53, thereby preventing the holder 11 from being fit into the receptacle 53. As a result, improper mounting of the auxiliary connector 28 can be detected.

The invention is not limited to the above described and illustrated embodiment. For example, the following embodiments are also embraced by the technical scope of the present invention as defined in the claims. Beside the following embodiments, various changes can be made without departing from the scope and spirit of the present invention as defined in the claims.

The returning slanted surfaces are formed only on the retainer in the foregoing embodiment. However, they may be formed only on the auxiliary connectors or on both the retainer and the auxiliary connectors.

The guiding slanted surface is formed only on the retainer in the foregoing embodiment. However, it may be formed only on the receptacle or on both the retainer and the receptacle according to the present invention.

Although the guiding slanted surface is provided in the foregoing embodiment, it may be omitted from the construction.

The receptacle has the dovetail grooves and the holder has the trapezoidal ribs as the restricting means in the foregoing embodiment. However, the receptacle may have the trapezoidal ribs and the holder may have the dovetail grooves or both the receptacle and the holder may have dovetail grooves and trapezoidal ribs according to the present invention.

The dovetail grooves and ribs of trapezoidal cross-section define the restricting means in the foregoing embodiment. However, grooves and ribs of the restricting means may have, for example, substantially L-shaped or substantially T-shaped cross sections instead of the trapezoidal cross sections.

The first and second connectors are connected by rotating the lever in the foregoing embodiment. However, the present invention also is applicable to connector assemblies in which both connectors are connected without using a lever or by using another operable member (such as a linearly displaceable operable member) that displays a cam action or pushing function for assisting or performing the connection of the two connectors.

What is claimed is:

1. A split-type connector comprising:

a holder;

auxiliary connectors configured for mounting in the holder along a mounting direction, each auxiliary connector having a detection rib, the auxiliary connectors each having at least one terminal fitting mounted therein; and a retainer mounted to the holder and movable along a retainer mounting direction between a first position where the auxiliary connectors can be mounted into the holder and a second position where the auxiliary connectors are locked in the holder by the retainer, at least one returning slanted surface formed on a front surface of the retainer, the returning slanted surface being disposed for being contacted by he detection ribs of the auxiliary connectors as the auxiliary connectors are being mounted into the holder and while the retainer is at the second position, the returning slanted surface being aligned at an acute angle to the mounting direction of the auxiliary connectors into the holder and at an acute angle to the retainer mounting direction so that the contact by the detection rib of the auxiliary connectors with the returning slanted surface pushes the retainer to the first position for permitting complete mounting of the auxiliary connectors into the holder.

2. The split-type connector of claim 1, wherein in the first position the retainer is retracted from mounting paths of the auxiliary connectors in the holder to permit the auxiliary connectors to be mounted into the holder.

3. The split-type connector of claim 2, wherein in the second position the retainer is in the mounting paths of the auxiliary connectors in the holder to lock the auxiliary connectors.

4. The split-type connector of claim 1, wherein a projecting portion of the retainer projects from the holder when the retainer is at the first position for interfering with an opening edge of a receptacle of a mating connector.

5. The split-type connector of claim 4, wherein a guiding slanted surface is provided on the projecting portion of the retainer, the guiding slanted surface being aligned for urging the retainer to the second position as the split-type connector is urged into the receptacle of the mating connector.

6. The split-type connector of claim 5, further comprising restricting means at an outer surface of the holder and engageable with a mating restricting means of the mating connector to prevent the receptacle from being deformed away from the holder.

7. The split-type connector of claim 6, wherein the restricting means is on a side of the holder where the retainer is mounted.

8. The split-type connector of claim 1, wherein the returning slanted surface further is dimensioned and disposed for being contacted by the auxiliary connectors when the retainer is at an intermediate position between the first and second positions.

9. The split-type connector of claim 1, wherein the retainer is free of locks for locking the retainer at the second position.

10. A split-type connector assembly, comprising:

a first connector having a holder and auxiliary connectors mounted in the holder along a mounting direction, each auxiliary connector having a detection rib formed thereon, a retainer provided at the holder and movable along a retainer mounting direction between a first position where the auxiliary connectors can be mounted into the holder and a second position where the auxiliary connectors are locked in the holder by engagement between the retainer and the detection rib;

a second connector including a receptacle into which the first connector is fittable; and wherein at least one of the retainer and the auxiliary connectors have at least one returning slated surface formed on a front surface thereof, the returning slanted surface being aligned at an acute angle to the mounting direction of the auxiliary connectors into the holder and at an acute angle to the retainer mounting direction such that the retaining ribs of the auxiliary connectors contact the returning slanted surface and push the retainer to the first position in the process of mounting the auxiliary connectors into the holder when the retainer is at the second position and when the retainer is at an intermediate position between the second and first positions.

11. The split-type connector assembly of claim 10, wherein in the first position the retainer is retracted from mounting paths of the auxiliary connectors in the holder to permit the auxiliary connectors to be mounted into the holder.

12. The split-type connector assembly of claim 11, wherein in the second position the retainer is in the mounting paths of the auxiliary connectors in the holder to lock the auxiliary connectors.

13. The split-type connector assembly of claim 12, wherein a projecting portion of the retainer projects from the holder for interfering with an opening edge of a receptacle of a mating connector when the retainer is at the first position.

14. The split-type connector assembly of claim 13, wherein a guiding slanted surface is provided on at least one of the projecting portion of the retainer and an inner side of the opening edge of the receptacle.

15. The split-type connector assembly of claim 14, further comprising restricting means at an inner surface of the receptacle and the outer surface of the holder and engageable with each other to prevent the receptacle from being deformed away from the outer surface of the holder.

16. The split-type connector assembly of claim 15, wherein the restricting means is provided on a side of the holder, where the retainer is mounted.

17. The split-type connector assembly of claim 10, wherein the retainer is free of locks for locking the retainer at the second position.

* * * * *